US005495734A

United States Patent [19]

Yu

[11] Patent Number: 5,495,734

[45] Date of Patent: Mar. 5, 1996

[54] KEY RING ASSEMBLY

[76] Inventor: San-chih Yu, No. 73-17, Sec. 2, Chung Hsing Rd., Ta Li City, Taichung Hsien, Taiwan

[21] Appl. No.: 380,387

[22] Filed: Jan. 30, 1995

[51] Int. Cl.[6] ..... A47G 29/10

[52] U.S. Cl. ..... 70/456 R; 24/3.6; 24/599.8; 24/701; 70/459

[58] Field of Search ..... 70/456 R, 459, 70/460; 24/116 A, 599.8, 3.6, 644, 701; 206/37.1, 38.1, 37.5, 37.6, 37.7, 37.8

[56] References Cited

U.S. PATENT DOCUMENTS

| | | | |
|---|---|---|---|
| 350,055 | 9/1886 | Hubbard | 24/599.8 |
| 4,584,858 | 4/1986 | Wolter | 70/456 R |
| 5,174,139 | 12/1992 | Huang | 70/456 R |
| 5,341,662 | 8/1994 | MacDonald | 70/456 R |
| 5,398,389 | 3/1995 | Terada et al. | 24/599.8 |

*Primary Examiner*—Lloyd A. Gall

*Attorney, Agent, or Firm*—Welsh & Katz, Ltd.

[57] ABSTRACT

A key ring assembly includes first and second half bodies which are coupled together, the first half body including a first flange portion laterally formed along a periphery thereof, a hook member having a first end portion located above a first distal end of the first flange portion and a second end portion formed on a second distal end of the first flange portion, a first opening defined between the first distal end of the first flange portion and the second end portion of the hook member, the second half body including a second flange portion laterally formed along a periphery thereof and facing towards the first flange portion, a sliding groove defined between the first and second flange portions, a second opening defined between first and second free ends of the second flange portion and communicating with the first opening, a retaining arm being in alignment with the first end portion of the hook member to form a loop and being able to slide between the first and second openings, a biasing member mounted between the first and second half bodies and including a first urging end abutting against the retaining arm and a second urging end abutting against the second end portion of the hook member.

4 Claims, 2 Drawing Sheets

KEY RING ASSEMBLY

BACKGROUND OF THE INVENTION

1. Field of Invention

The present invention relates to a key ring assembly.

2. Related Prior Art

A conventional key ring assembly is shown in FIG. 4. However, by such an arrangement, there are still some shortcomings in the conventional key ring assembly.

There will be a more complete and sufficient illustration in the detailed description of the preferred embodiments, concerning the conventional key ring assembly.

The present invention has arisen to mitigate and/or obviate the above-mentioned disadvantages of the conventional key ring assembly.

SUMMARY OF THE INVENTION

The primary objective of the present invention is to provide a key ring assembly which is easily operated and can be suspended on articles conveniently.

In accordance with one aspect of the present invention, there is provided a key ring assembly comprising a first half body having a first flange portion which is laterally formed along a periphery thereof and projects outwardly therefrom and comprises a first distal end and a second distal end, a hook member having a first end portion located above the first distal end of the first flange portion and a second end portion formed on the second distal end of the first flange portion, a first opening defined between the first distal end of the first flange portion and the second end portion of the hook member, a second half body coupled to the first half body and having a second flange portion which is laterally formed along a periphery thereof and projects therefrom facing towards the first flange portion and comprises a first free end and a second free end, a sliding groove defined between the first and second flange portions, a second opening defined between the first and second free ends of the second flange portion and communicating with the first opening, a pivot member pivotally mounted between the first and second half bodies, a retaining arm formed on the pivot member and abutting against the first distal end of the first flange portion and the first free end of the second flange portion and in alignment with the first end portion of the hook member to form a loop, the retaining arm being able to pivot with the pivot member to slide in the first and second openings, a biasing member mounted between the first and second half bodies and comprising a first urging end abutting against the retaining arm and a second urging end abutting against the second end portion of the hook member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 4:
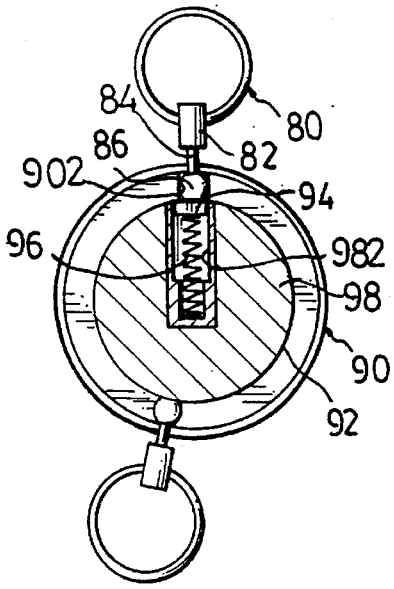
FIG. 4 PRIOR ART
FIG. 4 is a cross-sectional view of a conventional key ring assembly in accordance with the prior art.

Referring to FIG. 4, a conventional key ring assembly in accordance with the prior art comprises a pair of half bodies 90 which are coupled together with a connecting portion 98 fitted therebetween, a ring-shaped guiding groove 92 defined along a peripheral portion between the pair of half bodies 90, a plurality of key fasteners 80 (only two key fasteners are shown) each having a retaining block 82 stopped outside the pair of half bodies 90, a stop 86 retained in the guiding groove 92 between the pair of half bodies 90, and a linking member 84 connected between the retaining block 82 and the stop 86 and slidably guided in the guiding groove 92. By such an arrangement, the plurality of key fasteners 80 are able to slide in the guiding groove 92 freely. In addition, a compartment 982 is defined in the connecting portion 98 and communicates with the guiding groove 92, a recess 902 defined in one of the pair of half bodies 90 and communicating with the guiding groove 92 and located above and in alignment with the compartment 982, and a biasing member 96 mounted in the compartment 982 for urging a stopping block 94 upwardly to block the recess 902, thereby preventing the key fastener 80 from being detached from the pair of half bodies 90 through the recess 902.

In operation, a user may urge the stopping block 94 downwardly to detach from the recess 902, thereby being capable of releasing the stop 86 of the key fastener 80 from the pair of half bodies 90 through the recess 902. The stopping block 94 is synchronously returned to the original position when the urging force thereon is removed due to a returning action of the biasing member 96 so as to stop movement of other key fasteners 80 remaining on the key ring assembly. By such an arrangement, the stopping block 94 is not easily operated and controlled by the user. In addition, the arrangement is not provided with a hook member for suspending the key ring assembly on articles, so easily incurring an inconvenience for the user when in use.

Figure 1:
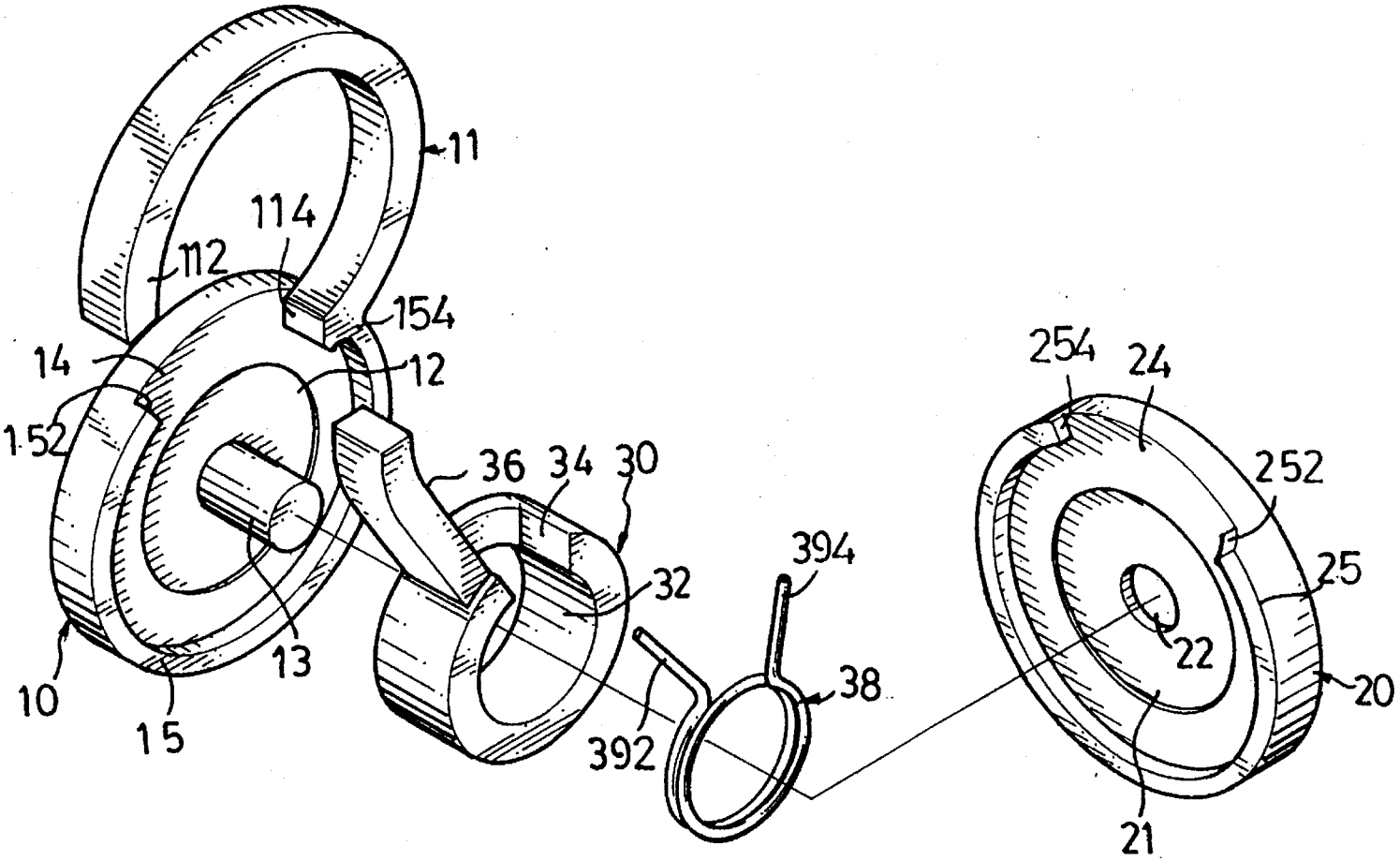
FIG. 1 is an exploded view of a key ring assembly in accordance with the present invention.
Figure 2:
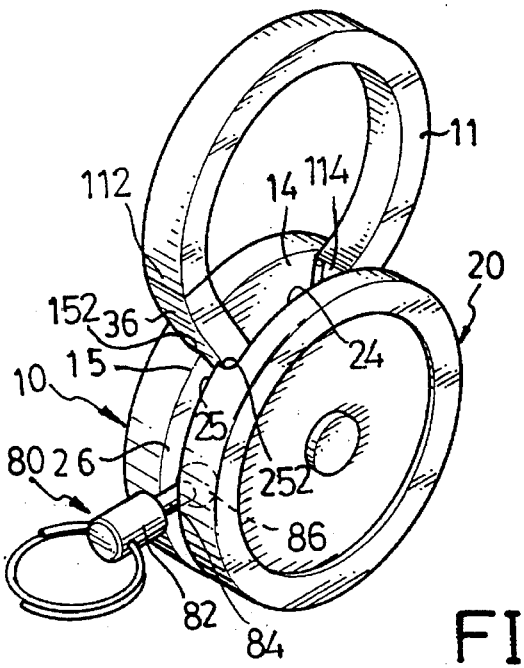
FIG. 2 is a perspective view showing a combination of the key ring assembly as shown in FIG. 1 with a key fastener.
Figure 3:
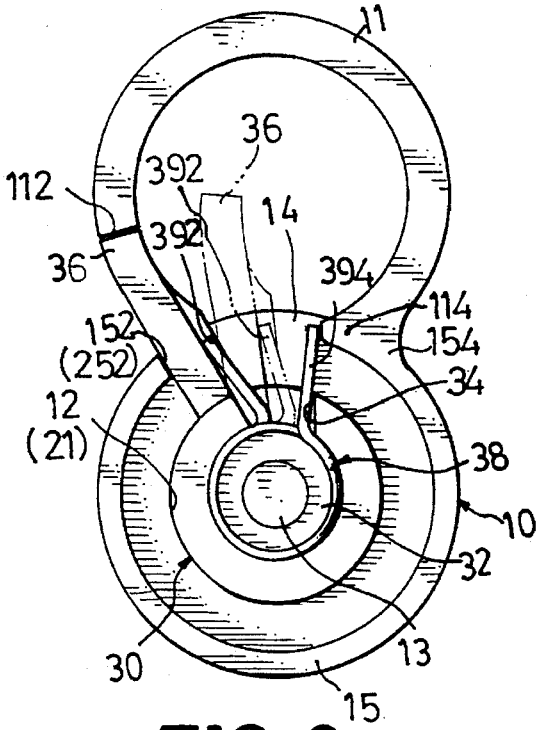
FIG. 3 is an operational view of the key ring assembly.

Referring to FIGS. 1–3, a key ring assembly in accordance with the present invention comprises a first half body 10 having a first flange portion 15 which is laterally formed along a periphery thereof and projects outwardly therefrom and comprises a first distal end 152 and a second distal end 154, a hook member 11 comprising a first end portion 112 located above the first distal end 152 of the first flange portion 15 and a second end portion 114 formed on the second distal end 154 of the first flange portion 15, and a first opening 14 defined between the first distal end 152 of the first flange portion 15 and the second end portion 114 of the hook member 11. A second half body 20 is coupled to the first half body 10 and comprises a second flange portion 25 laterally formed along a periphery thereof and projecting therefrom facing towards the first flange portion 15 and comprising a first free end 252 in alignment with the first distal end 152 of the first flange portion 15 and a second free end 254, a sliding groove 26 (see FIG. 2) defined between the first and second flange portions 15 and 25, and a second opening 24 defined between the first and second free ends 252 and 254 of the second flange portion 25 and communicating with the first opening 14.

A pivot member 30 is pivotally mounted between the first and second half bodies 10 and 20, a retaining arm 36 formed on the pivot member 30 and abutting against the first distal end 152 of the first flange portion 15 and the first free end 252 of the second flange portion 25 and in alignment with the first end portion 112 of the hook member 11 so as to form a loop, the retaining arm 36 being able to pivot with the pivot member 30 to slide between the first and second openings 14 and 24. A biasing member 38 is mounted between the first and second half bodies 10 and 20 and comprises a first urging end 392 abutting against the retaining arm 36 and a second urging end 394 abutting against the second end portion 114 of the hook member 11.

Preferably, a first depression 12 and a second depression 21 are respectively defined in the first and second half bodies 10 and 20 and are respectively flush with the pivot member 30 for retaining the pivot member 30 in place. In addition, the pivot member 30 has a compartment 32 transversely defined therethrough for receiving the biasing member 38 therein. A recess 34 is defined in the pivot member 30 beside the retaining arm 36 and communicating with the compartment 32 for receiving the first and second urging ends 392 and 394 of the biasing member 38 therein. The second half body 20 has a hole 22 defined through a mediate portion thereof, and the first half body 10 further comprises a positioning rod 13 formed on a mediate portion thereof and extending through the compartment 32 and the hole 22 so as to couple the first and second half bodies 10 and 20 together by means such as a rivet fitting arrangement.

In operation, referring to FIGS. 2 and 3, there are a plurality of key fasteners 80 (only one key fastener is shown) each having a retaining block 82 located outside the first and second half bodies 10 and 20, a stop 86 retained between the first and second flange portions 15 and 25, and a linking member 84 connected between the retaining block 82 and the stop 86 and slidably guided in the sliding groove 26. By such an arrangement, the plurality of key fasteners 80 are able to slide in the sliding groove 26 freely and the movement of the key fasteners 80 is stopped by the retaining arm 36 by means of the first urging end 392 of the biasing member 38 resting on the retaining arm 36, so preventing the key fasteners 80 from being detached from the key ring assembly. Referring to FIG. 3, a user may urge the retaining arm 36 together with the first urging end 392 to a position as shown in phantom lines, thereby releasing the key fastener 80 from the first and second half bodies 10 and 20 through the first and second openings 14 and 24. The retaining arm 36 is synchronously returned to the original position when the urging force thereon is absent due to a returning effect of the biasing member 38 so as to stop movement of other key fasteners 80 remaining on the key ring assembly.

It should be clear to those skilled in the art that further embodiments of the present invention may be made without departing from the teachings of the present invention.

What is claimed is:

1. A key ring assembly comprising:

a first half body having a first flange portion which is laterally formed along a periphery thereof and projects outwardly therefrom and comprises a first distal end and a second distal end, a hook member having a first end portion located above said first distal end of said first flange portion and a second end portion formed on said second distal end of said first flange portion, and a first opening defined between said first distal end of said first flange portion and said second end portion of said hook member;

a second half body coupled to said first half body and having a second flange portion which is laterally formed along a periphery thereof and projects therefrom facing towards said first flange portion and comprises a first free end and a second free end, a sliding groove defined between said first and second flange portions and, and a second opening defined between said first and second free ends of said second flange portion and communicating with said first opening;

a pivot member pivotally mounted between said first and second half bodies, a retaining arm formed on said pivot member and abutting against said first distal end of said first flange portion and said first free end of said second flange portion and in alignment with said first end portion of said hook member to form a loop, said retaining arm being able to pivot with said pivot member to slide in said first and second openings; and a biasing member mounted between said first and second half bodies and comprising a first urging end abutting against said retaining arm and a second urging end abutting against said second end portion of said hook member.

2. The key ring assembly in accordance with claim 1, wherein a first depression and a second depression are respectively defined in said first and second half bodies and respectively flush with said pivot member for retaining said pivot member in place.

3. The key ring assembly in accordance with claim 1, wherein said pivot member has a compartment longitudinally defined therethrough for receiving said biasing member therein, a recess defined in said pivot member beside said retaining arm and communicating with said compartment for receiving said first and second urging ends of said biasing member.

4. The key ring assembly in accordance with claim 3, wherein said second half body has a hole defined through a mediate portion thereof, and said first half body further comprises a positioning rod formed on a mediate portion thereof and extending through said compartment and said hole so as to couple said first and second half bodies together.

* * * * *